United States Patent [19]

Matsumoto et al.

[11] Patent Number: 4,814,319

[45] Date of Patent: Mar. 21, 1989

[54] HEAT AND PRESSURE SENSITIVE RECORDING MATERIAL

[75] Inventors: Shinichi Matsumoto; Nobuhiko Kitada; Akihiro Tanaka, all of Takatsuki, Japan

[73] Assignee: Naigai Carbon Ink Co., Ltd., Takatsuki, Japan

[21] Appl. No.: 919,734

[22] Filed: Oct. 16, 1986

[30] Foreign Application Priority Data

Oct. 16, 1985 [JP] Japan ..... 60-231497

[51] Int. Cl.[4] ..... B41M 5/22

[52] U.S. Cl. ..... 503/216; 427/151; 428/913; 428/914; 503/214; 503/217; 503/218; 503/220; 503/226

[58] Field of Search ..... 503/214, 226, 218, 220, 503/221, 216, 217; 427/150–152; 428/913, 914

[56] References Cited

U.S. PATENT DOCUMENTS

| | | | |
|---|---|---|---|
| Re. 30,041 | 7/1979 | Maalouf | 503/226 |
| 4,425,386 | 8/1986 | Roylance | 427/256 |
| 4,520,378 | 5/1985 | Matsushita et al. | 503/215 |
| 4,598,035 | 7/1986 | Usami et al. | 503/215 |

FOREIGN PATENT DOCUMENTS

| | | | |
|---|---|---|---|
| 22875 | 1/1981 | European Pat. Off. | 503/226 |
| 0012693 | 1/1982 | Japan | 503/226 |
| 579689 | 6/1982 | Japan | 503/226 |

*Primary Examiner*—Bruce H. Hess

*Attorney, Agent, or Firm*—Jones, Tullar & Cooper

[57] ABSTRACT

Disclosed is a heat and pressure sensitive recording material for recording and duplicating, comprising an up sheet I and a down sheet II, wherein the up sheet I is coated on one surface with a composition A comprising a colorless electron donative organic compound 1 and an acidic organic compound 2 which develops the color of the compound 1 when heat is applied, and is coated on the other side facing the down sheet II with a composition B comprising the compound 1, an encapsulated compound 1' of the compound 1 and a hot metal material 3. The down sheet II is coated on the side facing the up sheet I with a composition C comprising the organic compound 2. The heat and pressure sensitive recording material may further have inserted between the up sheet I and the down sheet II at least one middle sheet III coated with the composition C on one side and with the composition B on the other side.

12 Claims, 2 Drawing Sheets

HEAT AND PRESSURE SENSITIVE RECORDING MATERIAL

FIELD OF THE INVENTION

The present invention relates to a heat and pressure sensitive recording material for recording and duplicating.

BACKGROUND OF THE INVENTION

Heat sensitive recording materials are widely known. They are generally obtained by coating a substrate sheet with an aqueous dispersion containing a colorless electron donative organic compound (such as crystal violet lactone), an organic acidic compound and a binder, and then drying it. These heat sensitive recording materials are used as paper for recording information in facsimile machines, cardiograph machines and computer terminals.

It is often desired that information to be recorded be duplicated into two or three sheets. Japanese Patent Publications Nos.(examined) 36865/1979 and 43900/1979 disclose heat and pressure sensitive recording materials employing a transparent or translucent substrate sheet. It however, is difficult to read the recorded information due to transparency of the substrate sheet. It is also considered that two or more sheets of heat sensitive paper are piled up in order for a duplication. However, since paper absorbs heat in a significant amount, the temperature of an outer layer is decreased and a developed color becomes light and faint.

Further, heat sensitive recording materials which are currently available for a handy terminal, often make the surface of things dirty by its color, because they use carbon ink.

SUMMARY OF THE INVENTION

The present invention provides a heat and pressure sensitive recording material not having the problems mentioned above. The heat and pressure sensitive recording material comprises an up sheet I and a down sheet II, wherein the up sheet I is coated on the surface with a composition A comprising a colorless electron donative organic compound 1 and an acidic organic compound 2 which develops the color of the compound 1 when heat is applied and is coated on the other side facing the down sheet II with a composition B comprising the compound 1, an encapsulated compund 1' of the compound 1 and a hot melt material 3. The down sheet II is coated on the side facing the up sheet I with a composition C comprising the organic compound 2.

The present invention also provides a heat and pressure sensitive recording material having more than three sheets wherein at least one middle sheet III is inserted between the up sheet I and the down sheet II and the middle sheet III is coated on the up sheet side with a composition C comprising an acidic organic compound 2 and on the down sheet side with a composition B comprising a colorless electron donative organic compound 1, an encapsulated compund 1' of the compound 1 and a hot melt material 3.

DETAILED DESCRIPTION OF THE PRESENT INVENTION

Figure 1:
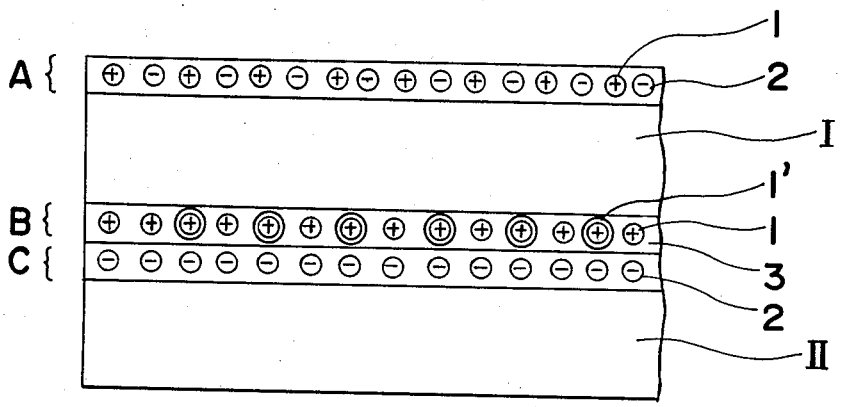
FIG. 1 is a sectional view schematically showing one embodiment of the present invention.

The colorless electron donative organic compounds 1 used in the present invention are leuco compounds including triphenyl methanes, fluorans, spiropyrans, auramines and phenothiazines. Representative examples of the compounds are 3,3-bis(p-dimethylaminophenyl)-6-dimethylaminophthalide, 3,3-bis(p-dimethylaminopheny)phthalide, 3-(N-p-tolyl-N-ethylamino)-6-methyl-7-(N-phenylamino)fluoran, 2-{N-(3'-trifruoromethylphenyl)amino}-6-diethylaminofluoran, 3-diethylamino-7-chlorofluoran, 6'-chloro-8'-methoxybenzoindolinospyropyran, Benzoyl Leuco Methyleneblue and the like.

In addition to the organic compounds 1, encapsulation of compound 1 are employed in the present invention. These are referred to as encapsulated compounds 1'. Encapsulating methods are known to those skilled in the art. Representative methods are a coacervation method using hydrophilic colloid sol, such as is disclosed in U.S. Pat. No. 2,800,457 and U.S. Pat. No. 2,800,458: and an interfacial polymerization method, such as is disclosed in U.K. Patent Nos. 867,797, 950,443, 989264, 1,091,075 and the like. According to the present invention, the encapsulated compound 1' is used in a dried form.

The acidic organic compounds 2 which are used for developing the color of the compound 1 mentioned above include clays, such as montmorillonite, Attapulgite, bentonite, clay, kaoline and the like: phenol derivatives, such as 4-t-butylphenol, 4-phenylphenol, 2,2-bis(-phydroxyphenyl)propane, 2,2-bis(p-hydroxyphenyl)butane, a condensation of 4-t-butylphenol and formaldehyde, alphanaphthol, beta-naphthol, a metal salt of salicylic acid derivatives (for example, a zinc salt of 5-t-amylsalicylic acid, a zinc salt of 5-phenyl salicylic acid, a zinc salt of 5-(4-hydroxyphenyl)-salicylic acid, a zinc salt of 3-methyl-5-phenylsalicylic acid, and a zinc salt of a condensation of salicylic acid and formaldehyde): a mixture thereof: and the like. Preferred are a mixture of the phenol derivatives such as 2,2-bis(p-hydroxyphenyl)propane and a zinc salt of salicylic acid derivatives, such as 5-(4-hydroxyphenyl)salicylic acid.

The hot melt materials 3 employed in the present invention are those having a melting point of 30° to 110° C. Most of the materials 3 are wax including carnauba wax, montan wax, ouricury wax, candelilla wax, coconut wax, paraffin wax, micorcrystalline wax, Hoechst wax (OP, O and the like), Bareco wax (WB wax), NPS wax, rice wax, lower molecule polyethylene wax, stearic acid, palmitic acid, myristic acid, a fatty acid amid such as stearoamide, ketone wax such as stearone. By "wax" is meant a material which is changed to a liquid having a decreased viscosity when heated and the liquid is returned to a crystalline solid when cooled below its melting point. The term "wax" herein intends to cover not only higher fatty acids and esters of higher alcohol, but also the other materials having the characteristics mentioned above.

As shown in FIG. 1, an up sheet I is coated with a composition A on one surface. The composition A is generally an aqueous composition containing both the electron donative organic compound 1 and the acidic organic compound 2. If necessary, it may further contain a watersoluble binder. Examples of the water-soluble binders are polyvinyl alcohol, starch, carboxymethylcellulose, acrylic emulsion, casein, polysacharide and the like. The amount of the electron donative compound 1 is 1 to 50, preferably 3 to 30% by weight based on the composition. Amounts less than 1% by weight develop a light and faint color and amounts more than 50% by weight do not produce an expected color. The amount of the acidic compound 2 is 5 to 80% by weight, preferably 10 to 60% by weight based on the weight of the composition A. Amounts less than 5% by weight also develop a light and faint color and amounts more than 80% by weight do not provide an expected color-development and decline its workability. The compounds 1 and 2 are reactive with each other and therefore color development may occur when the compounds 1 and 2 are mixed and left for a long time. Accordingly, it is preferred that the compounds 1 and 2 are respectively mixed with a binder and water to form two compositions and then the two compositions are mixed together just before coating. The up sheet I is coated with the composition A and then dried.

The composition B comprises an electron donative compound 1, an encapsulated electron donative compound 1' and a hot melt material 3. The composition B is melted by heat and then coated on the other side of the up sheet I. The capsule of the encapsulated electron donative compound 1' is broken by pressure and the electron donative compound 1 in the capsule is reacted with the acidic organic compound 2 to develop an image. When heat is applied, the hot melt material 3 is melted and the electron donative compound 1 which is not encapsulated is reacted with the acidic organic compound 2 to develop an image. The weight ratio of the encapsulated compound 1' to the compound 1 not encapsulated is 1:1 to 10:1, preferably 2:1 to 5:1. Weight ratios outside of the ratio mentioned above provide lack of either pressure sensitivity or heat sensitivity. The weight ratio of the compound 1 including both the encapsulated compound 1' and the non-encapsulated compound 1 to the hot melt material 3 is not limited, but is preferably 3 to 15 parts by weight, more preferably 3 to 50 parts by weight based on 100 parts by weight of the hot melt material 3.

The sheet employed in the present invention can be paper or plastic film and the like. Preferred are paper having a weight of 15 to 40 g/m$^2$, preferably 20 to 40 g/m$^2$. Weights less than 15 g/m$^2$ result in a decreased operating efficiency during coating, and weights more than 40 g/m$^2$ result in a decreased heat conductivity of a thermal head in a thermal printer, which makes color light and faint.

A down sheet II is coated with a composition C comprising the acidic organic compound 2 and if desirable a resin solution such as SBR latex, polyvinyl alcohol, nitrocellulose. The amount of the acidic organic compound 2 is 1 to 50% by weight, preferably 5 to 50% by weight based on the total amount of the composition C. Amounts less than 5% by weight develop a faint color. Amounts more than 50% by weight result in decline of workability.

Figure 2:
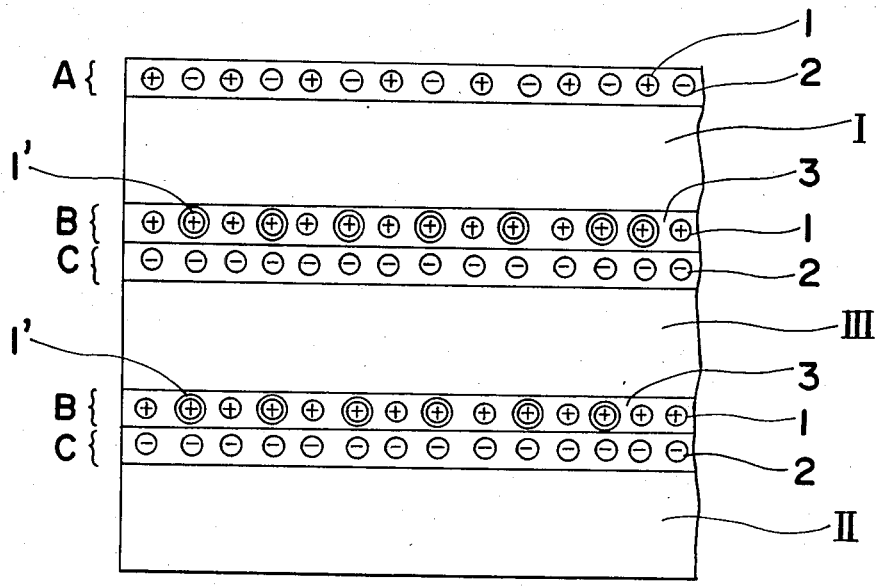
FIG. 2 is a sectional view schematically showing another embodiment of the present invention.

If one or more middle sheets III are employed for duplicating as shown in FIG. 2, the middle sheets III are coated on the up sheet side with the composition C and on the down sheet side with the composition B.

The down sheet II and middle sheet III can be paper, plastic film and the like. Paper is preferred.

Figure 3:
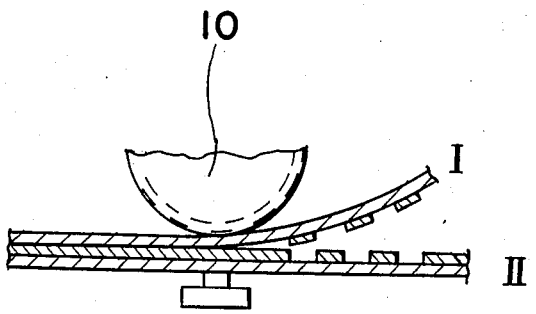
FIG. 3 is a sectional view schematically showing an application of the embodiment of FIG. 1 to a thermal head.
Figure 4:
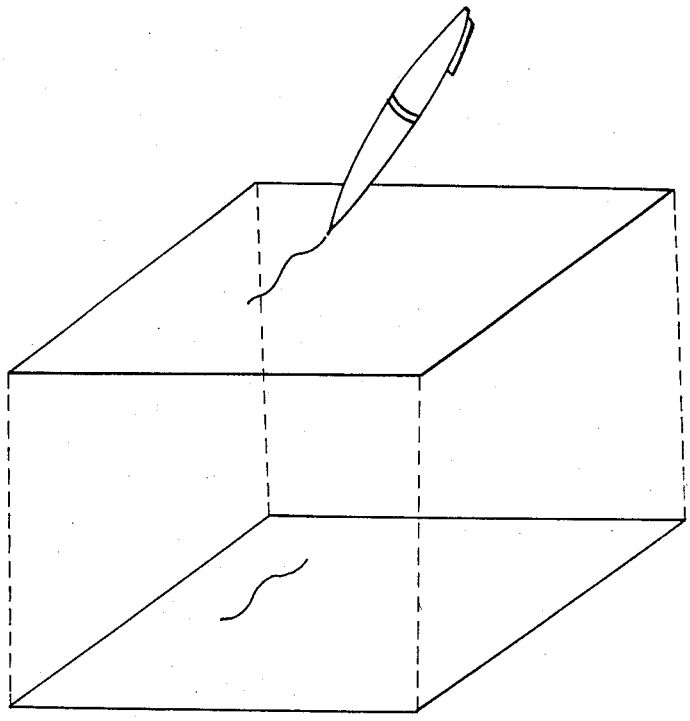
FIG. 4 shows an application of the heat and pressure sensitive recording material described in FIG. 1 to a pressure sensitive recording material.

According to the present invention, since the electron donative organic compound 1 to be coated on a sheet is dispersed in the hot melt material 3, a developing temperature is easily adjusted by choice of the hot melt material 3. In other words, decrease of a developing temperature can be achieved by only selecting a wax having a low melting point and a low melt viscosity. As is shown in FIG. 3, a thermal head 10 is generally located above the up sheet I. The wax to be coated on the other side of the thermal head 10 should be one which has a lower melting point than the acidic organic compound 2 having been coated on the thermal head side. For example, if a developing temperature on the surface of the up sheet I is 100° C., the hot melt material to be coated on the other side of the up sheet I should be one having a melting point of 60° to 70° C. If the heat and pressure sensitive recording materials of the present invention have three sheets, the melting point of the hot melt materials is made lower as it becomes apart from the thermal head. Further, in the case where the recording materials are used as pressure sensitive recording materials, as shown in FIG. 4, a good image can be obtained by a pressure of a pencil or a ball point pen. Thus the recording materials of the present invention can obtain a good image from either heat or pressure and do not make the surface of things dirty.

The present invention is illustrated by the following examples which should not be construed as limiting the scope of the invention to their details.

EXAMPLE 1

A composition B was prepared from the following ingredients.

| Ingredients | Parts by weight |
|---|---|
| 3,3-Bis(p-dimethylaminophenyl-6-dimethylaminophthalide | 5.0 |
| Benzoyl Leuco Methyleneblue | 2.5 |
| Paraffin wax 115° | 45.0 |
| ARMIDE HT[1] | 15.0 |
| HOECHST WAX OP[2] | 8.0 |
| Candelilla wax | 7.0 |
| Encapsulated 3,3-bis(dimethylamino-phenyl)-6-dimethylaminophthalide | 17.5 |

[1]Stearylamide available from Lyon Armer Co. Ltd.
[2]Available from Hoechst A.G.

The ingredients were melted at a temperature of 120° to 130° C. to form a mixture. The mixture was then cooled to 70° to 80° C. at which the mixture was coated on a heat sensitive sheet available from Honshu Seishi Co. Ltd. as Corona Heat Sensitive Paper in an amount of 2.0 to 5.0 g/m$^2$ to form an up sheet.

EXAMPLE 2

A composition B was prepared from the following ingredients.

| Ingredients | Parts by weight |
|---|---|
| 2-{N—(3'-trifluoromethylphenyl) amino}-6-diethylaminofluoran | 7.0 |
| Paraffin wax 115° | 50.0 |
| ARMIDE HT | 5.0 |
| Carnauba wax | 15.0 |
| Encapsulated 2-{N—(3'-trifluoro-methylphenyl)amino}-6-diethylaminofluoran | 23.0 |

The ingredients were treated as generally described in Example 1 to form an up sheet.

EXAMPLE 3

A composition C was prepared from the following ingredients.

| Ingredients | Parts by weight |
|---|---|
| ARMIDE HT | 10.0 |
| 2,2-Bis(phydroxyphenyl)propane | 60.0 |
| A zinc salt of 5-(4-hydroxyphenyl)-salicylic acid | 10.0 |
| NITROCOTTON SS1/4 | 25.0 |
| Ethyl acetate | 55.0 |
| Ethyl alcohol | 30.0 |
| Toluene | 20.0 |

The above ingredients were dispersed and then coated on one sheet of high grade paper by a Mayer Bar Coater in an amount of 2.0 to 6.0 g/m$^2$ based on a dried solid content to form a down sheet.

The up sheet prepared in Example 1 was combined with the down sheet and developed by using Handy terminal HT-5000P available from Canon Corporation. The developed image was clear and blue. The up sheet prepared in Example 2 was also combined with the down sheet and developed as described above. The developed image was clear and black. The heat sensitive recording materials combined as mentioned above were tested by writing with a ball point pen. The images thus developed were clear and have distinguish colors.

What is claimed is:

1. A heat and pressure sensitive recording material for recording and duplicating, comprising: an up sheet I; and a down sheet II, wherein the up sheet I is coated on one surface with a composition A comprising a colorless electron donative organic compound 1 and a acidic organic compound 2 which develops the color of said compound 1 when heat is applied, and is coated on the other side facing the down sheet II with a composition B comprising said compound 1 and a hot melt material 3, wherein a portion of said compound 1 is encapsulated with microcapsules which are capable of being broken by pressure, and wherein the down sheet II is coated on the side facing the up sheet I with a composition C comprising said organic compound 2.

2. The heat and pressure sensitive recording material of claim 1 wherein the electron donative organic compound 1 is selected from the group consisting of 3,3-bis(p-dimethylaminophenyl)-6-dimethylaminophthalide, 3,3-bis(p-dimethylaminophenyl)phthalide, 3-(N-p-tolyl-N-ethylamino)-6-methyl-7-(N-phenylamino)fluoran, 2-{N-(3'-trifruoromethylphenyl)amino}-6-diethylaminofluoran, 3-diethylamino-7-chlorofluoran, 6'-chloro-8'-methoxybenzoindolino-spyropyran, and Benzoyl Leuco Methyleneblue.

3. The heat and pressure sensitive recording material of claim 1 wherein the acidic organic compound 2 is a mixture of 2,2-bis(p-hydrophenyl)propane and 5-(4-hydrophenyl)-salicylic acid.

4. The heat and pressure sensitive recording material of claim 1 wherein the hot melt material 3 is a wax having a melting point of 30° to 110° C.

5. The heat and pressure sensitive recording material of claim 1 wherein the composition A further comprises a water-soluble binder.

6. The heat and pressure sensitive recording material of claim 1 wherein the composition C further comprises a resin solution.

7. A heat and pressure sensitive recording material for recording and duplicating, comprising: an up sheet I; at least one middle sheet III; and a down sheet II, wherein the up sheet I is coated on one surface with a composition A comprising a colorless electron donative organic compound 1 and an acidic organic compound 2 which develops the color of said compound 2 when heat is applied, and is coated on the down sheet side with a composition B comprising said compound 1 and a hot melt material 3, wherein a portion of said compound 1 is encapsulated with microcapsules which are capable of being broken by pressure, the down sheet II is coated on the up sheet side with a composition C comprising said organic compound 2, and said at least one middle sheet III is inserted between the up sheet I and the down sheet II and is coated on the up sheet side with a composition C comprising an acidic organic compound 2 and on the down sheet side with a composition B comprising a colorless electron donative organic compound 1, and a hot melt material 3, wherein a portion of said compound 1 is encapsulated with microcapsules which are capable of being broken by pressure.

8. The heat and pressure sensitive recording material of claim 7 wherein the electron donative organic compound 1 is selected from the group consisting of 3,3-bis(p-dimethylaminophenyl)-6-dimethylaminophthalide, 3,3-bis(p-dimethylaminophenyl)phthalide, 3-(N-p-tolyl-N-ethylamino)-6-methyl-7-(N-phenylamino)fluoran, 2-{N-(3'-trifruoromethylphenyl)amino}-6-diethylaminofluoran, 3-diethylamino-7-chlorofluoran, 6'-chloro-8'-methoxybenzoindolino-spyropyran, and Benzoyl Leuco Methyleneblue.

9. The heat and pressure sensitive recording material of claim 7 wherein the acidic organic compound 2 is a mixture of 2,2-bis(p-hydrophenyl)propane and 5-(4-hydrophenyl)-salicylic acid.

10. The heat and pressure sensitive recording material of claim 7 wherein the hot melt material 3 is a wax having a melting point of 30° to 110° C.

11. The heat and pressure sensitive recording material of claim 7 wherein the composition A further comprises a water-soluble binder.

12. The heat and pressure sensitive recording material of claim 7 wherein the composition C further comprises a resin solution.

* * * * *